US007515119B2

(12) United States Patent
Kim et al.

(10) Patent No.: US 7,515,119 B2
(45) Date of Patent: Apr. 7, 2009

(54) METHOD AND APPARATUS FOR CALCULATING AN AVERAGE PICTURE LEVEL AND PLASMA DISPLAY USING THE SAME

(75) Inventors: Yong Duek Kim, Daegu-kwangyeokshi (KR); Bon Cheol Koo, Daegu-kwangyeokshi (KR); Jae Chan Lee, Daegu-kwangyeokshi (KR); Myung Kwan Ko, Kutni-shi (KR); Mi Young Cho, Busan-kwangyeokshi (KR)

(73) Assignee: LG Electronics Inc., Seoul (KR)

( * ) Notice: Subject to any disclaimer, the term of this patent is extended or adjusted under 35 U.S.C. 154(b) by 658 days.

(21) Appl. No.: 10/803,907

(22) Filed: Mar. 19, 2004

(65) Prior Publication Data

US 2004/0183764 A1 Sep. 23, 2004

(30) Foreign Application Priority Data

Mar. 21, 2003 (KR) ..... 10-2003-0017757

(51) Int. Cl.
*G09G 3/28* (2006.01)

(52) U.S. Cl. ..... 345/63; 345/690; 382/162; 382/272; 382/274

(58) Field of Classification Search ..... 345/63, 345/84, 60, 690, 88, 20, 89; 382/162, 167, 382/169, 189, 214, 272, 274
See application file for complete search history.

(56) References Cited

U.S. PATENT DOCUMENTS

| | | | | |
|---|---|---|---|---|
| 6,380,943 | B1 | 4/2002 | Morita et al. | |
| 7,095,888 | B2 * | 8/2006 | Kim | 382/162 |
| 7,161,607 | B2 * | 1/2007 | Choi | 345/690 |
| 2002/0175922 | A1 * | 11/2002 | Koo et al. | 345/589 |
| 2005/0140587 | A1 * | 6/2005 | Cho | 345/63 |

FOREIGN PATENT DOCUMENTS

| | | |
|---|---|---|
| CN | 1277707 | 12/2000 |
| KR | 2001-0032155 | 4/2001 |
| WO | WO 00/17845 | 3/2000 |

* cited by examiner

*Primary Examiner*—Amr Awad
*Assistant Examiner*—Michael Pervan
(74) *Attorney, Agent, or Firm*—KED & Associates, LLP

(57) ABSTRACT

The present invention discloses a method and an apparatus for calculating an optimal Average Picture Level (APL) in a plasma display of asymmetric cell configuration wherein each red, green and blue cell has asymmetric size and a plasma display using the same.

15 Claims, 5 Drawing Sheets

METHOD AND APPARATUS FOR CALCULATING AN AVERAGE PICTURE LEVEL AND PLASMA DISPLAY USING THE SAME

BACKGROUND OF THE INVENTION

1. Field of the Invention

The present invention relates to a plasma display panel, and more particularly to a method and an apparatus for calculating an optimal Average Picture Level (hereinafter referred to as an "APL") and to a plasma display capable of enhancing a display quality using the same.

2. Description of the Related Art

A plasma display displays a picture using the visible ray generated from a phosphorus material when the phosphorus material is excited by the ultraviolet rays generated by a gas discharge. The plasma display has advantages that it is thinner and lighter than a cathode ray tube (CRT) which has been a display means mast widely used so far and that it is possible to be made into a high definition screen and bigger in size.

The plasma display is driven with time division scheme wherein one frame is divided into several sub-fields that have different light emission frequency, in order to realize the gray level of a picture. Each sub-field is divided again into a reset period for generating a uniform discharge, an address period for selecting discharge cells and a sustain period for realizing gray levels depending on a discharge frequency. For instance, in the event that it is desired to display a picture with 256 gray levels, a frame period 16.67 ms corresponding to 1/60 second is divided into eight(8) sub-fields. In addition, each of 8 sub-fields is divided again into the reset period, the address period and the sustain period. Herein, the reset period and the address period are identically repeated for each sub-field, but on the other hand, the sustain period and the discharge frequency thereof are proportionally increased depending on the number of sustain pulses at the rate of $2^n$ (where n=0, 1, 2, 3, 4, 5, 6, 7) in each sub-field. In this way, since the sustain period becomes different in each sub-field, it is possible to realize the gray level of a picture.

In such a plasma display, luminosity is decided in accordance with the number of sustain pulses. Accordingly, if the number of the sustain pulses are same in each sub-field in case that average luminosity is either lighter or darker, there may arise various problems such as a deterioration of picture quality, excessive power consumption and a damage of a plasma display panel (PDP) due to a non-uniform of average luminosity. For instance, a contrast property may be deteriorated in case that the number of the sustain pulses is set less for every input image. Moreover, in case of setting the number of the sustain pulses more for every input image, the luminosity and the contrast property may be improved even in dark images, but the PDP may be damaged because of increasing the power consumption and the temperature of the PDP. Accordingly, it is needed to appropriately adjust the number of the sustain pulses depending on the average luminosity of the input images. To this end, the plasma display includes a circuit for controlling the number of the sustain pulses in accordance with an APL.

Referring to FIG. 1, there is shown a block diagram representing a related art plasma display. The plasma display includes a gain controller 12 connected between a first reverse gamma corrector 11A and a data aligner 15, an error diffuser 13, a sub-field mapping unit 14, and an APL calculator 16 connected between a second reverse gamma controller 11B and a waveform generator 17.

The first and the second reverse gamma correctors 11A and 11B linearly change brightness for a gray level value of image signals by reverse gamma correcting digital video is data RGB supplied from input lines.

The gain controller 12 functions to adjust gains of the digital video data corrected by the reverse gamma corrector 11A by the amount of effective gains.

The error diffuser 13 adjusts minutely a brightness value by diffusing quantization errors of the digital video data RGB provided from the gain controller 12 throughout adjacent cells. To this end, the error diffuser 13 divides the digital video data into an integer portion and a decimal portion and multiplies the latter by Floid-Steinber's coefficient.

The sub-field mapping unit 14 maps the digital video data provided from the error diffuser 13 to sub-field patterns stored in advance and provides the mapped data to the data aligner 15.

The data aligner 15 provides the digital video data input from the sub-field mapping unit 14 to the data driving circuit of a plasma display panel (hereinafter referred to as a "PDP") 18. The data driving circuit is connected to data electrodes in the PDP 18, latches the digital video data provided from the data aligner 15 by every one horizontal line, and then provides the latched data by one horizontal period unit to the data electrodes in the PDP 18.

The APL calculator 16 detects by frame unit an average brightness, i.e., APL, for the digital video data RGS input from the second reverse gamma corrector 11B and outputs information on the number of sustain pulses (NSUS) corresponding to the detected APL. For instance, the APL is divided into 256 steps from 0 to 255 assuming that input digital video data is of 8-bit.

The waveform generator 17 generates a timing control signal in response to the information on the number of sustain pulses from the APL calculator 16 and provides it to a scan driving circuit and a sustain driving circuit not shown in FIG. 1. The scan driving circuit and the sustain driving circuit provide sustain pulses to scan electrodes and sustain electrodes in the PDP 18 in response to the timing control signal provided from the waveform generator 17. Generally, a pixel in a PDP includes a set of red, green and blue sub-pixels.

If each red, green and blue sub-pixel is manufactured with the same size, it is difficult to optimize a white balance and a color coordinate of the plasma display without using a particular circuit due to the difference of the unique saturation property of red, green, and blue phosphorus materials. In recent, a PDP of the asymmetric cell configuration wherein the red, green and blue sub-pixels are made to have different sizes, respectively is suggested so as to correct the white balance and the color coordinate.

However, since the conventional method of calculating an APL is made on a condition that all the sub-pixels have the same sizes as mentioned above, an optimal AFL cannot be calculated in the PDP based on the asymmetric cell configuration.

SUMMARY OF THE INVENTION

Accordingly, it is an object of the present invention to provide a method and an apparatus for calculating the optimal Average Picture Level (APL).

It is another object of the present invention to provide a plasma display to improve a display quality using the same method and apparatus.

In order to achieve these and other objects of the invention, a method for calculating an APL according to the present invention includes applying a first weight to a red data; applying a second weight to a green data; applying a third weight to a blue data; and calculating the APL for the red, green and blue data with the applied weights.

The weights are determined depending on the sizes of red, green and blue sup-pixels, respectively.

The weights have different value in each red, green, blue data.

In the method, the step of applying the weights includes multiplying the first weight to the red data; multiplying the second weight to the green data; and multiplying the third weight to the blue data.

In the method, the step of calculating the APL includes calculating a first APL for the red data, a second APL for the green data and a third APL for the blue data; adding the first, the second, the third APLs for the red, the green and the blue data to produce the summation therefor; and calculating a mean value of the summation.

The weights are changeable.

The weights are changeable by users.

An apparatus for calculating an Average Picture Level (APL) includes means for applying a first, a second and a third weights to a red, a green and a blue data respectively; and an APL calculator for calculating the APL for the red, the green, and the blue data with the applied weights.

The weights are determined depending on the sizes of red, green and blue sup-pixels, respectively.

The weights have different values in the red, green, blue data respectively.

The means for applying the weights includes a first multiplier for multiplying the red data by the first weight; a second multiplier for multiplying the green data by the second weight; and a third multiplier for multiplying the blue data by the third weight.

The APL calculator calculates a first APL for the red data, a second APL for the green data and a third APL for the blue data adds the first, the second, the third APLs for the red, the green and the blue data to produce the summation therefor; and calculates a mean value of the summation.

The weights are changeable.

The weights are changeable by users.

A plasma display includes means for applying a first, a second and a third weights to a red, a green and a blue data, respectively; an APL calculator for calculating an APL for the red data, the green data and the blue data with the applied weights; and a driving circuit for displaying a picture using the APL.

The weights are determined depending on the sizes of red, green and blue sup-pixels, respectively.

The weights have different values in the red, green, blue data, respectively.

The means for applying weights includes a first multiplier for multiplying the red data by the first weight; a second multiplier for multiplying the green data by the second weight; and a third multiplier for multiplying the blue data by the third weight.

The APL calculator calculates a first APL for the red data, a second APL for the green data and a third APL for the blue data adds the first, second, third APLs for the red, the green and the blue data to produce the summation therefor and calculates a mean value of the summation.

The driving circuit differently controls the number of sustain pulses according to the mean value.

The weights are changeable by users.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to FIGS. 4 and 5.

Figure 4:
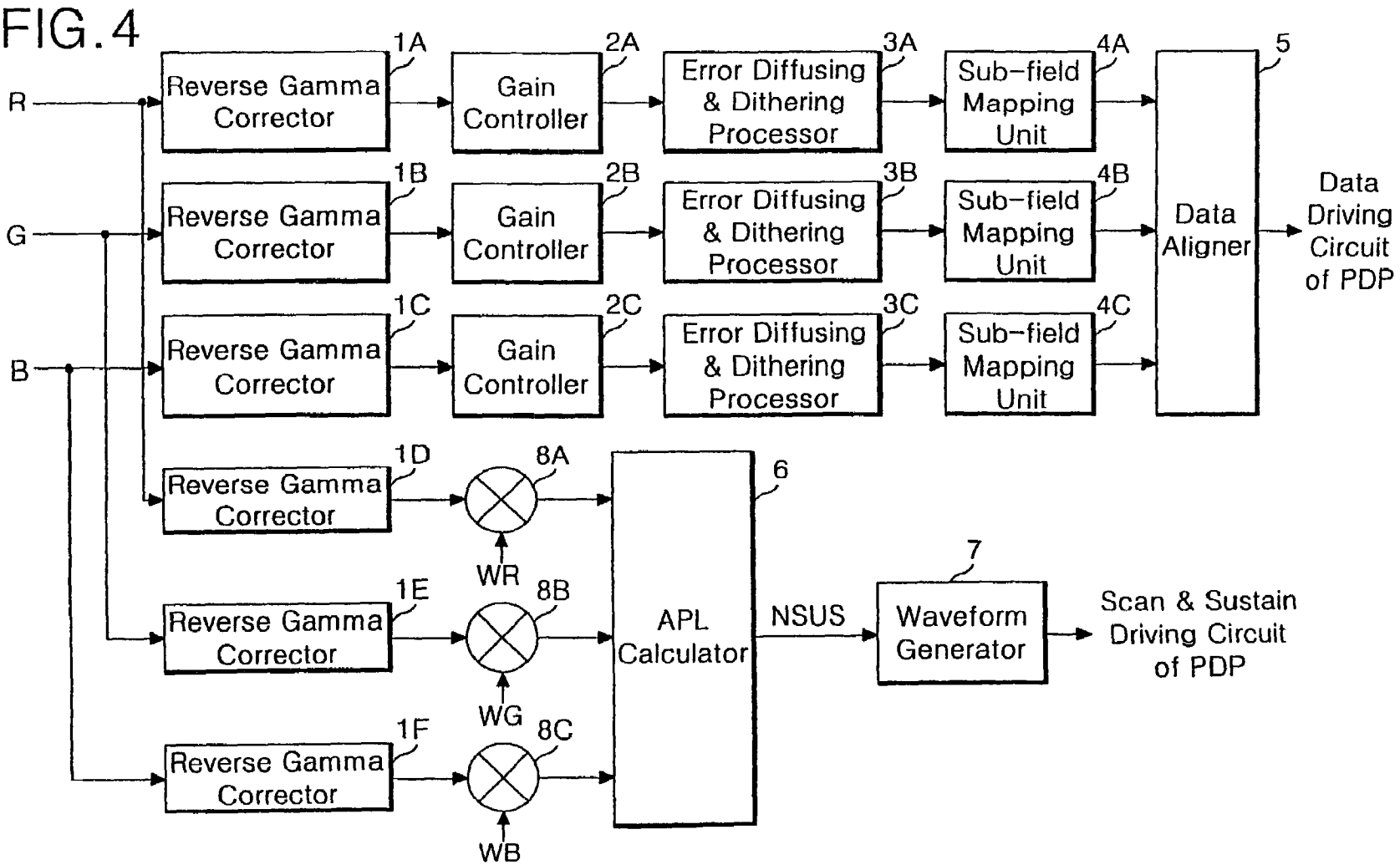
FIG. 4 is a block diagram representing a plasma display according to an embodiment of the present invention.

Referring to FIG. 4, there is shown a plasma display according to an embodiment of the present invention. The plasma display includes reverse gamma correctors 1A to 1F in order to perform a reverse gamma correction for digital video data RGB, gain controllers 2A to 2C, error diffusing & dithering processors 3A to 3C, sub-field mapping units 4A to 4C, and a data aligner 5 connected between the reverse gamma correctors 1A to 1C and a data driving circuit, and multipliers 8A to 8C, an APL calculator 6 and a waveform generator 7 connected between the reverse gamma correctors 1D to 1F and a scan & sustain driving circuit not shown of the PDP.

Each of the reverse gamma correctors 1A to 1F performs the operation of reverse gamma correction for the digital video data R(Red),G(Green),B(Blue) applied from input lines to linearly change brightness for the gray level value of a picture signal.

The gain controllers 2A to 2C adjust gains of the digital video data corrected by the corresponding reverse gamma correctors 1A to 1C, respectively, by the amount of effective gains.

The error diffusing & dithering processors 3A to 3C diffuse quantization errors of the digital video data RGB input from the gain controllers 2A to 2C throughout adjacent pixel data using a Floid-Steinberg error diffusing filter. Moreover, the error diffusing & dithering processors 3A to 3C threshold the digital video data RGB with a dither mask (or a dither matrix) having a predetermined threshold value corresponding to each pixel.

The sub-field mapping units 4A to 4C map the digital video data provided from the error diffusing & dithering processors 3A to 3C to sub-field patterns stored in advance and provide the mapped data to the data aligner 5.

Figure 1:
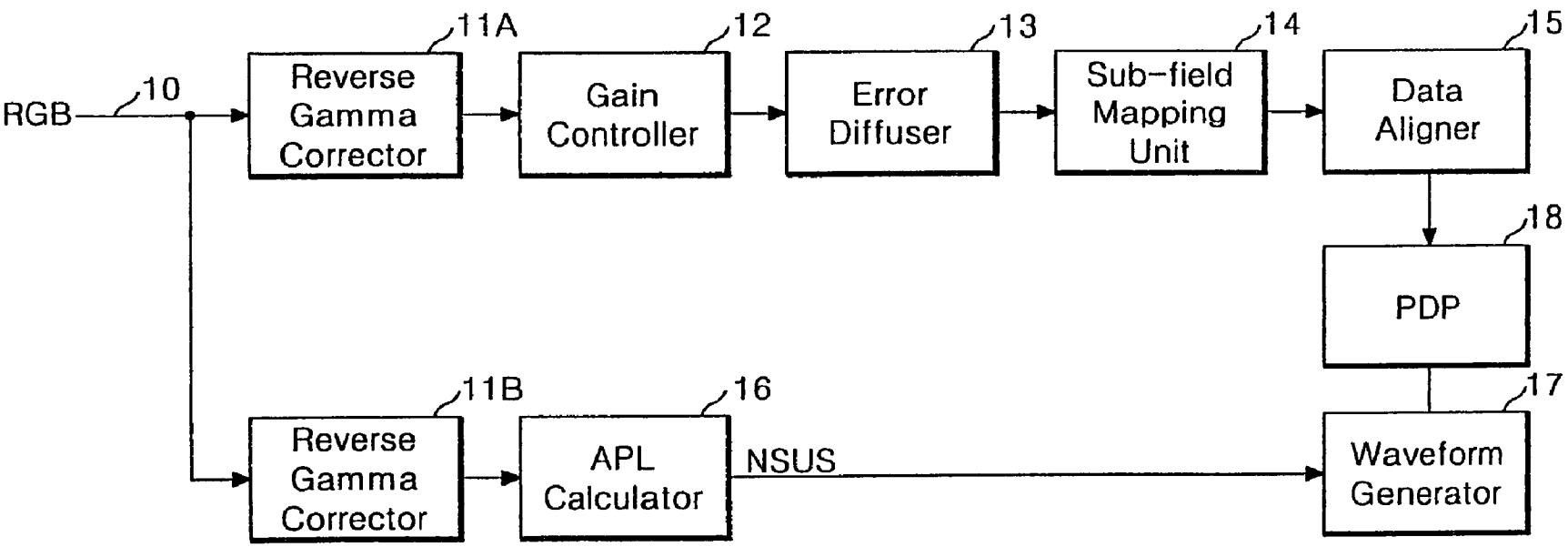
FIG. 1 RELATED ART
FIG. 1 is a block diagram representing a related art of a plasma display.
Figure 2:
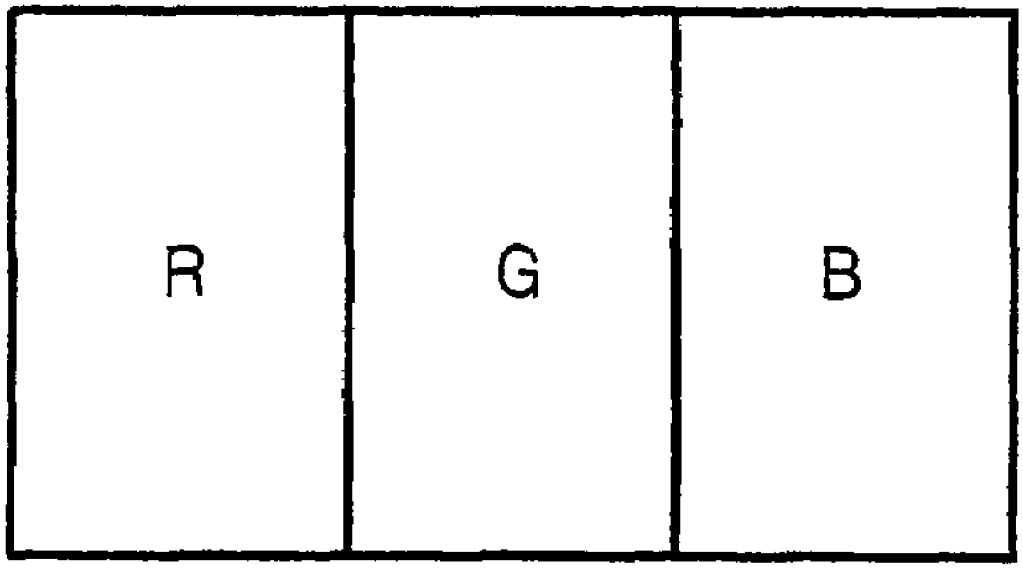
FIG. 2 RELATED ART
FIG. 2 is a plane view representing that the size of red, green and blue sub-pixels is identical with each other.
Figure 3:
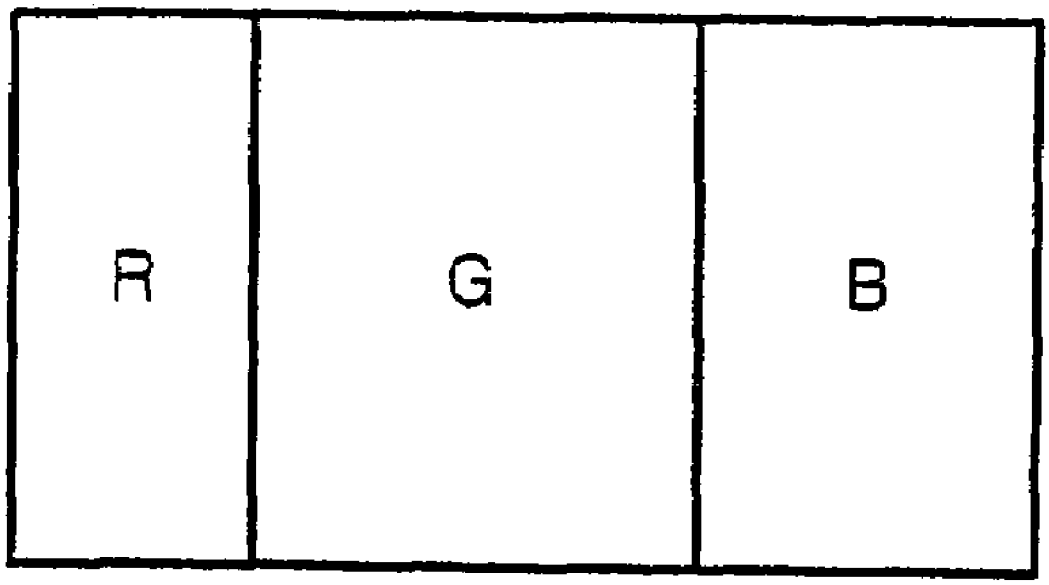
FIG. 3 RELATED ART
FIG. 3 is a plane view representing that the size of red, green and blue sub-pixels is different with each other.

The multipliers 8A to 8C multiply the digital video data RGB processed by a reverse gamma correction, by predetermined weights WR, WG and WB, respectively, and provide the weighted digital video data to the APL calculator 6. The weights WR, WG and WB have different values with each other depending on each size of red, green and blue cells. For instance, provided that a ratio of each size of red, green and blue sub-pixels in FIG. 3 is 0.8:1.2:1, the weights WR, WG and WB may be set to as 0.8, 1.2 and 1. These weights WR, WG and WB may be set differently in consideration of not only the asymmetric size of sub-pixels but also an intrinsic saturation property of phosphorous materials. These weights are stored in advance as a type of a lookup table not shown in FIG. 4.

In the present invention, the weights WR, WG and WB may be changed through a user interface, for instance, a remote controller or an on-screen display, not shown in FIG. 4, by users and by testers (or operators) according to a picture quality test given by a manufacturing company.

The APL calculator 6 calculates a first APL for the data R, a second APL for the data G and a third APL for the data B, and adds the first, the second, the third APLs for the data R, G and B to produce the summation of the APLs for the data R, G and B. Moreover, in the APL calculator 6, the summation of the APLs is divided by three in order to calculate a mean value thereof. The mean value is used as an optimal APL for the asymmetric cell configuration. Moreover, the APL calculator 6 outputs information on the number of sustain pulses (NSUS) in accordance with the optimal APL.

The waveform generator 7 generates a timing control signal in response to the information on the number of sustain pulses from the APL calculator 6 and provides the timing control signal to a scan & sustain driving circuit. The scan & sustain driving circuit provides sustain pulses to scan and sustain electrodes in the PDP 18 during a sustain period in response to the timing control signal provided from the wave generator 7.

Figure 5:
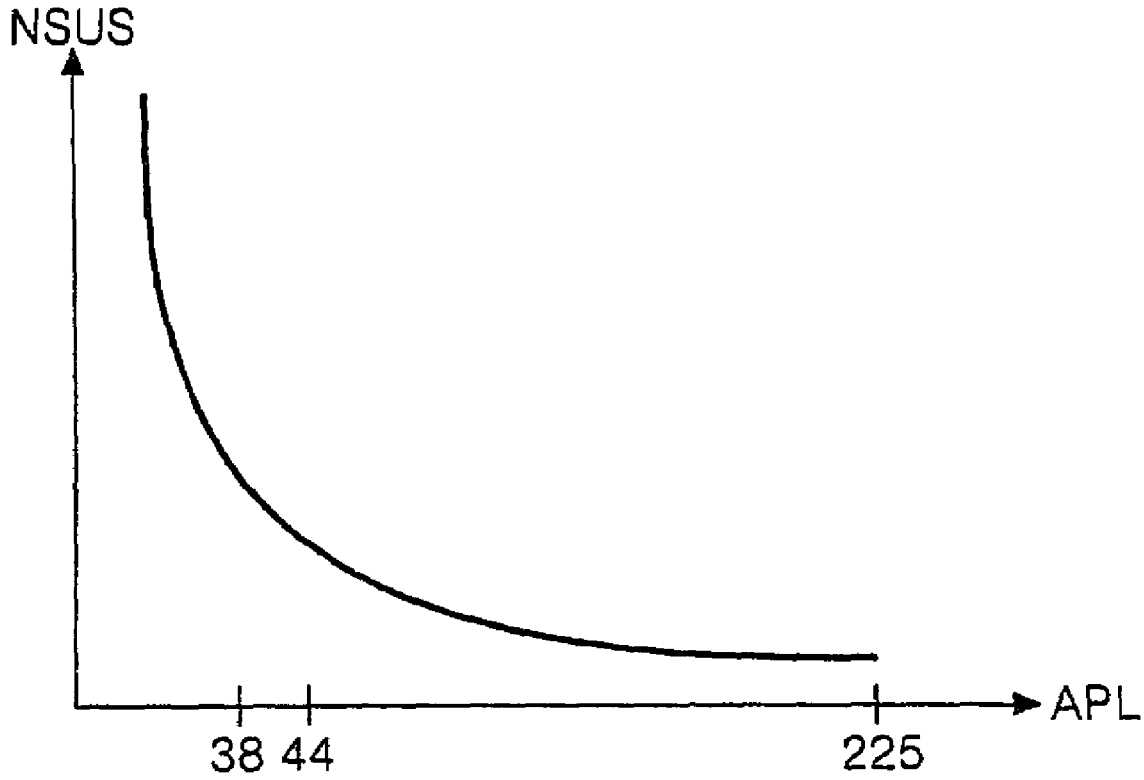
FIG. 5 is a graph comprising APLs calculated by the related art and the embodiment of the present invention.

FIG. 5 illustrates a graph comparing the APL produced by an embodiment of the present invention and an example of the APL produced by a conventional method for calculating an APL. In FIG. 5, it is assumed that the red, green and blue data be '4', '100' and '10', respectively.

In FIG. 5, assuming that the conventional method calculates the APL as a value of 38 by dividing 114(=4+100+10) by three.

In contrast, the present method for calculating an APL is to multiply red, green and blue data by predetermined weights WR, WG and WB, respectively, in consideration of the asymmetric cell configuration wherein each size of red, green and blue cells is different or an intrinsic saturation property of phosphorous materials. For instance, if the weights for red, green and blue cells are 0.8, 1.2 and 1, respectively, the present method is to calculate the optimal APL as a value of 44 by dividing 133.2(=(4*0.8)+(100*1.2)+(10*1)) by three.

As described above, the method and an apparatus for calculating an AFL according to the present invention is capable of achieving the optimal APL in consideration of an asymmetric cell configuration wherein each size of red, green and blue cells is different or an intrinsic saturation property of phosphorous materials. As a result, the plasma display according to the present invention is capable of optimizing the white balance and the color coordinate in the PDP of the asymmetric cell configuration.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. For instance, the present invention is applicable not only to a plasma display but also to a flat panel display (FPD) such as an organic electro luminescence display (OLED) or a liquid crystal display.

Accordingly, the scope of the invention shall be determined only by the appended claims and their equivalents.

What is claimed is:

1. A method for calculating an Average Picture Level (APL), comprising:

applying a first weight to a red data;

applying a second weight to a green data;

applying a third weight to a blue data; and calculating the APL for the red, green and blue data with the applied weights, wherein the first, second and third weights are determined depending on sizes of red, green and blue sup-pixels, respectively, wherein calculating the APL includes:

calculating a first APL for the red data, a second APL for the green data and a third APL for the blue data;

adding the first APL, the second APL, and the third APL to produce a summation thereof; and calculating a mean value of the summation.

2. The method of claim 1, wherein each of the weights has different value in each red, green, blue data.

3. The method of claim 1, wherein applying the weight includes:

multiplying the first weight to the red data;

multiplying the second weight to the green data; and multiplying the third weight to the blue data.

4. The method of claim 1, wherein the weights are changeable.

5. The method of claim 1, wherein the weights are changeable by a user.

6. An apparatus for calculating an Average Picture Level (APL) comprising:

means for applying a first weight, a second weight and a third weight to a red, a green and a blue data, respectively, wherein the first, second and third weights are determined depending on sizes of red, green and blue sup-pixels, respectively; and an APL calculator for calculating the APL for the red, the green and the blue data with the applied weights, wherein the APL calculator calculates a first APL for the red data, a second APL for the green data and a third APL for the blue data, the APL calculator further adding the first APL, the second APL, and the third APL to produce a summation thereof, and the APL calculator calculating a mean value of the summation.

7. The apparatus of claim 6, wherein the weights have different values in each red, green, and blue data.

8. The apparatus of claim 6, wherein the means for applying the weights includes:

a first multiplier for multiplying the red data by the first weight;

a second multiplier for multiplying the green data by the second weight; and a third multiplier for multiplying the blue data by the third weight.

9. The apparatus of claim 6, wherein the weights are changeable.

10. The apparatus of claim 6, wherein the weights are changeable by a user.

11. A plasma display comprising:

means for applying a first weight, a second weight and a third weight to a red data, a green data and a blue data, respectively, wherein the first, second and third weights are determined depending on sizes of red, green and blue sup-pixels, respectively;

an APL calculator for calculating an average picture level (APL) for the red data, the green data and the blue data with the applied weights, wherein the APL calculator calculates a first APL for the red data, a second APL for the green data and a third APL for the blue data, the APL calculator further adds the first APL, the second APL, and the third APL to produce a summation thereof, and the APL calculator calculates a mean value of the summation; and a driving circuit for displaying a picture using the APL.

12. The plasma display of claim 11, wherein the weights have different values in the red data, the green data, and the blue data, respectively.

13. The plasma display of claim 11, wherein the means for applying weights includes:

a first multiplier for multiplying the red data by the first weight;

a second multiplier for multiplying the green data by the second weight; and a third multiplier for multiplying the blue data by the third weight.

14. The plasma display of claim 11, wherein the driving circuit differently controls a number of sustain pulses according to the calculated mean value.

15. The plasma display of claim 11, wherein the weights are changeable by a user.

* * * * *